US012752204B2

(12) United States Patent
Gu

(10) Patent No.: US 12,752,204 B2
(45) **Date of Patent: *Oct. 6, 2026**

(54) INFLATABLE DOLL

(71) Applicant: COMIN INTERNATIONAL INC, Los Angeles, CA (US)

(72) Inventor: Yumin Gu, Los Angeles, CA (US)

(73) Assignee: COMIN INTERNATIONAL INC, Los Angeles, CA (US)

( * ) Notice: Subject to any disclaimer, the term of this patent is extended or adjusted under 35 U.S.C. 154(b) by 672 days.

This patent is subject to a terminal disclaimer.

(21) Appl. No.: 18/195,373

(22) Filed: May 10, 2023

(65) Prior Publication Data

US 2023/0381678 A1 Nov. 30, 2023

Related U.S. Application Data

(63) Continuation-in-part of application No. 17/828,061, filed on May 31, 2022, now Pat. No. 11,691,088.

(51) Int. Cl.
*A63H 3/06* (2006.01)
*A63H 3/36* (2006.01)

(52) U.S. Cl.
CPC ..... *A63H 3/06* (2013.01); *A63H 3/36* (2013.01)

(58) Field of Classification Search
CPC . A63H 3/06; A63H 3/28; A63H 27/10; A63H 2027/1033; A63H 2027/1058; A63H 2027/1075
USPC ..... 446/220, 223, 226
See application file for complete search history.

(56) References Cited

U.S. PATENT DOCUMENTS 5,380,234 A * 1/1995 Ledford ..... A63H 3/06 446/362
6,186,857 B1 * 2/2001 Gazit ..... G09F 15/0025 40/406
6,447,361 B1 * 9/2002 Akiyama ..... A63H 27/10 137/625.21
6,786,793 B1 * 9/2004 Wang ..... A63H 27/10 446/176
7,197,841 B2 * 4/2007 Hsu ..... G09F 15/0025 40/212
7,216,446 B2 * 5/2007 Machala ..... G09F 19/00 446/221

(Continued)

FOREIGN PATENT DOCUMENTS

CN 2662400 Y 12/2004
CN 201015713 Y 2/2008

(Continued)

*Primary Examiner* — Joseph B Baldori
(74) *Attorney, Agent, or Firm* — AVEK IP, LLC

(57) ABSTRACT

The present disclosure provides an inflatable doll, which includes a body having a first air inlet, a plurality of expandable members received in the body and connected with the body, and an air blower assembly. Each expandable member defines a second air inlet. The air blower assembly includes a first air blower arranged adjacent to the first air inlet and a plurality of second air blowers received in the body and communicated with second air inlets. The first air blower is configured to introduce air into the body to inflate the body and the expandable members. Each second air blower is configured to direct air out of one corresponding expandable member, so that the expandable members are deformed to move the body.

20 Claims, 17 Drawing Sheets

(56) References Cited

U.S. PATENT DOCUMENTS

| | | | | |
|---|---|---|---|---|
| 7,322,137 | B2 * | 1/2008 | Machala | G09F 19/08 40/410 |
| 8,800,186 | B2 * | 8/2014 | Zhang | G09F 19/02 40/610 |
| 8,851,955 | B2 * | 10/2014 | Zhang | A63H 3/06 446/268 |
| 10,227,972 | B2 * | 3/2019 | Shao | F04B 49/02 |
| 10,713,981 | B2 * | 7/2020 | de Grasse | G09F 19/08 |
| 10,830,229 | B1 * | 11/2020 | Lurker | F04B 35/04 |
| 11,691,088 | B1 * | 7/2023 | Gu | A63H 3/006 446/220 |
| 12,070,699 | B1 * | 8/2024 | Gu | F04D 25/166 |
| 2006/0111012 | A1 * | 5/2006 | Machala | G09F 19/08 446/226 |
| 2007/0022642 | A1 * | 2/2007 | Hsu | G09F 15/0025 446/226 |
| 2008/0233831 | A1 * | 9/2008 | Hsu | F04D 29/4246 446/221 |
| 2009/0286449 | A1 * | 11/2009 | Tsai | A63H 3/06 446/224 |
| 2014/0148079 | A1 * | 5/2014 | Zhang | A63H 13/02 446/226 |
| 2017/0056779 | A1 * | 3/2017 | Zhang | F16K 11/0525 |
| 2020/0316487 | A1 | 10/2020 | Hunter et al. | |

FOREIGN PATENT DOCUMENTS

| | | | |
|---|---|---|---|
| CN | 202951241 | U | 5/2013 |
| CN | 209848308 | U | 12/2019 |
| CN | 213049376 | U | 4/2021 |
| CN | 216439961 | U | 5/2022 |
| CN | 218129952 | U | 12/2022 |
| CN | 218221067 | U | 1/2023 |
| CN | 116271859 | A | 6/2023 |
| CN | 2821757 | Y | 7/2023 |

* cited by examiner

INFLATABLE DOLL

CROSS-REFERENCE TO RELATED APPLICATIONS

This application is a continuation-in-part of application Ser. No. 17/828,061 filed on May 31, 2022, the content of which is incorporated herein by reference.

FIELD

The present disclosure relates to the field of dolls, and in particular to an inflatable doll.

BACKGROUND

At present, all kinds of conventional inflatable dolls are displayed in or in front of supermarkets or amusement parks to attract customers or visitors and create a friendly atmosphere. A conventional inflatable decoration has a body made of fabric material and a barrel which has a base formed on a lower end of the barrel. The body is mounted on the barrel so that the body is suspended above the ground. An air inlet is defined in the base and in communication with the interior of the body and an inflator is mounted on the base. A vent hole is defined in the inflator and corresponds to the air inlet so that air can be blown into the body when the inflator is operating. Hence, the body erects to attract the customers.

However, the conventional inflatable doll lacks dynamic movement and so soon becomes unattractive to passersby. Therefore, the present disclosure provides an inflatable doll to mitigate or obviate the aforementioned problems.

SUMMARY

The present disclosure provides an inflatable doll, which includes a body having a first air inlet, a plurality of expandable members received in the body and connected with the body, and an air blower assembly. Each expandable member defines a second air inlet. The air blower assembly includes a first air blower arranged adjacent to the first air inlet and a plurality of second air blowers received in the body and communicated with second air inlets. The first air blower is configured to introduce air into the body to inflate the body and the expandable members. Each second air blower is configured to direct air out of one corresponding expandable member, so that the expandable members are deformed to move the body.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

Figure 1:
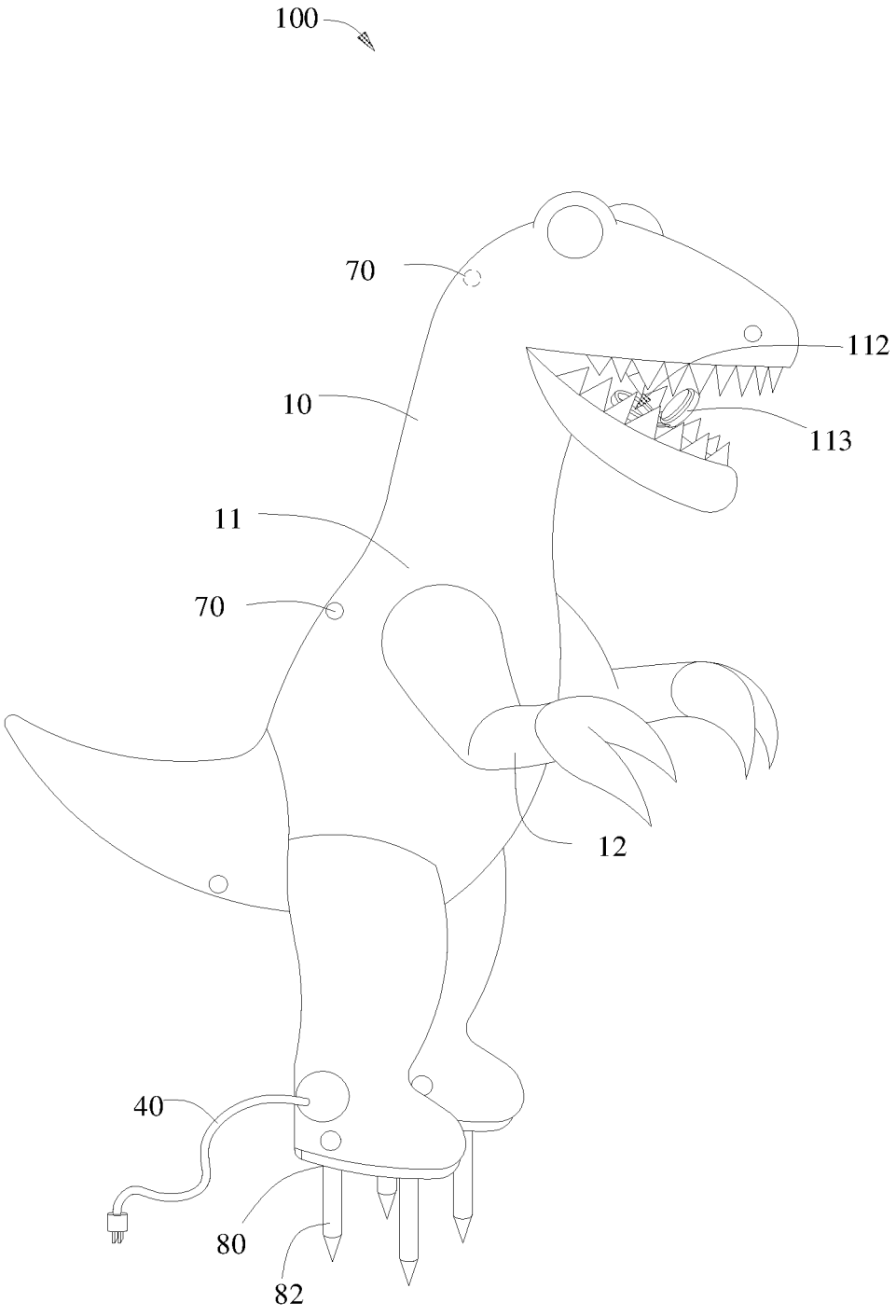
FIG. 1 is a structural schematic view of an inflatable doll in an inflated state according to a first embodiment of the present disclosure.

The realization of the aim, functional characteristics, advantages of the present disclosure are further described specifically with reference to the accompanying drawings and embodiments.

DETAILED DESCRIPTION

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

Referring to FIGS. 1-7 and 14-16, the present disclosure provides an inflatable doll 100 according to a first embodiment.

The inflatable doll 100 includes a body 10, a plurality of expandable members 20 and an air blower assembly 30 all received in the body 10. The body 10 includes a primary portion 11 having a first air inlet 111, and at least one secondary portion 12 connected and communicated with the primary portion 11. The expandable member 20 defines a second air inlet 21 communicated with first air inlet 111. The expandable members 20 are connected with the primary portion 11 and/or the secondary portion 12. The expandable members 20 are expandable, flexible or deformable, and capable of expanding or contracting under an action of the air blower assembly 30. The expandable members 20 are deformed to move the primary portion 11 and/or the secondary portion 12. In one embodiment, all portions of the expandable member are expandable, flexible and deformable.

The air blower assembly 30 includes a first air blower 31 received in the primary portion 11 and adjacent to the first air inlet 111, and a plurality of second air blowers 32. Each second air blower 32 is arranged on one corresponding second air blower 32, in detail, each second air blower 32 is at least partially received in one corresponding second air inlet 21. The first air blower 31 is configured to introduce air into the primary portion 11 and the secondary portion 12, to inflate the primary portion 11, the secondary portion 12 and the expandable members 20. Each second air blower 32 is configured to direct air out of one corresponding expandable member 20, the expandable members 20 are deformed to move the primary portion 11 and/or the secondary portion 12. In this way, the expandable members 20 can be controlled to deform independently, and different portions of the inflatable doll 100 can move independently.

The second air blowers 32 are intermittently actuated, so that the primary portion 11 and/or the secondary portion 12 is intermittently inflated or deflated, for bringing the primary portion 11 and/or the secondary portion 12 to move.

The body 10 is made of flexible material which can be inflated to expand and erect to a prearranged configuration, and can also be deflated to perform different attractive actions. In detail, the body 10 is made of air-tight cloth, air-tight fabric, rubber, polyphthalamide, thermoplastic urethanes (TPU), polyphenylenesulfide-based fiber (PPS), polyetheretherketone-based fiber (PEEK), nylon, and the like wholly aromatic polyamide fiber, wholly aromatic polyester fiber, polyimide-based fiber, polyetherimide-based fiber, vinylon-based fiber, acrylic-based fiber, cellulose-based fiber, silicon carbide-based fiber, alumina-based fiber, glass-based fiber, carbon-based fiber, steel-based fiber, and the like.

The expandable member 20 is made of fabric material or flexible plastic material which can be inflated to expand and erect to a prearranged configuration, and can also be deflated to move the body 10. In detail, the expandable member 20 is made of air-tight cloth, air-tight fabric, rubber, polyphthalamide, thermoplastic urethanes (TPU), polyphenylenesulfide-based fiber (PPS), polyetheretherketone-based fiber (PEEK), nylon, and the like wholly aromatic polyamide fiber, wholly aromatic polyester fiber, polyimide-based fiber, polyetherimide-based fiber, vinylon-based fiber, acrylic-based fiber, cellulose-based fiber, silicon carbide-based fiber, alumina-based fiber, glass-based fiber, carbon-based fiber, steel-based fiber, and the like.

In the preferred embodiment, the inflatable doll 100 is like a dinosaur, the primary portion 11 is a dinosaur body including a belly, a neck and a leg, and the secondary portion 12 includes an arm, a jaw, and a tail. In other embodiments, the inflatable doll 100 may be like a human, a car, a rabbit, and so on.

An air inlet portion of the first air blower 31 is communicated with the first air inlet 111. So that, the external air may be blown into the body 10. The second air blower 32 is arranged in the expandable member 20 and faces towards the outside of the expandable member 20, and an air outlet portion 321 of the second air blower 32 faces towards the outside of the expandable member 20. So that, the air in the expandable member 20 may be directed out of the expandable member 20, to move the primary portion 11 and/or the secondary portion 12. In detail, the air outlet portion 321 of the second air blowers 32 faces towards a same direction or different directions.

As shown in FIGS. 14-17, the expandable member 20 includes an inner side 201 and an outer side 202. The second air inlet 21 passes through the inner side 201 and the outer side 202. The second air blower 32 further includes a housing 320, a first air inlet portion 322 and a second air inlet portion 323 both protruded from the housing 320 and received in the expandable member 20, the air outlet portion 321 is also protruded from the housing 320, and the air outlet portion 321 is arranged outside the expandable member 20. The first air inlet portion 322 is connected with the second air inlet portion 323. Preferably, the first air inlet portion 322 is perpendicular to the second air inlet portion 323. The housing 320 includes a support wall 3203 arranged outside the expandable member a cylindrical body 3204 connected with the support wall 3203 and arranged outside the expandable member 20, and a connecting portion 3205 connected between the cylindrical body 3204 and the first air inlet portion 322 and arranged in the expandable member 20. A fan 3205 is arranged in the cylindrical body 3204 and configured to direct the air in the expandable member 20 out.

The first air inlet portion 322 extends from the connecting portion 3205 of the housing 320 along a first direction, the first direction is parallel with an axis direction of the housing 320. The air outlet portion 321 extends from the support wall 3203 of the housing 320 along a second direction. The first air inlet portion 322 has a round shape, and a diameter of the first air inlet portion 322 is greater than that of the connecting portion 3205, and a diameter of the cylindrical body 3204 is also greater than that of the connecting portion 3205, so that the first air inlet portion 322, the connecting portion 3205 and the cylindrical body 3204 cooperatively form a fixing portion 3206 which may be a fixing groove. The second direction is perpendicular to the first direction. The second air inlet portion 323 has a semicircle shape and extends from the first inlet portion 322 along the first direction. The first air inlet portion 322 defines at least one first inlet 3221, the second air inlet portion 323 defines at least one second inlet 3231, the air outlet portion 321 defines at least one outlet 3211 communicated with the first inlet 3221 and the second inlet 3231. The air in the expandable member 20 is directed out by the first inlet 3221, the second inlet 3231 and the outlet 3211, and the air in the body 10 can flow into the expandable member 20 by the outlet 3211, the first inlet 3221 and the second inlet 3231. In one embodiment, an extension direction of the first inlet 3221 is perpendicular to the first direction, an extension direction of the second inlet 3231 is parallel with the first direction, and an extension direction of the outlet 3211 is also perpendicular to the first direction.

Figure 18:
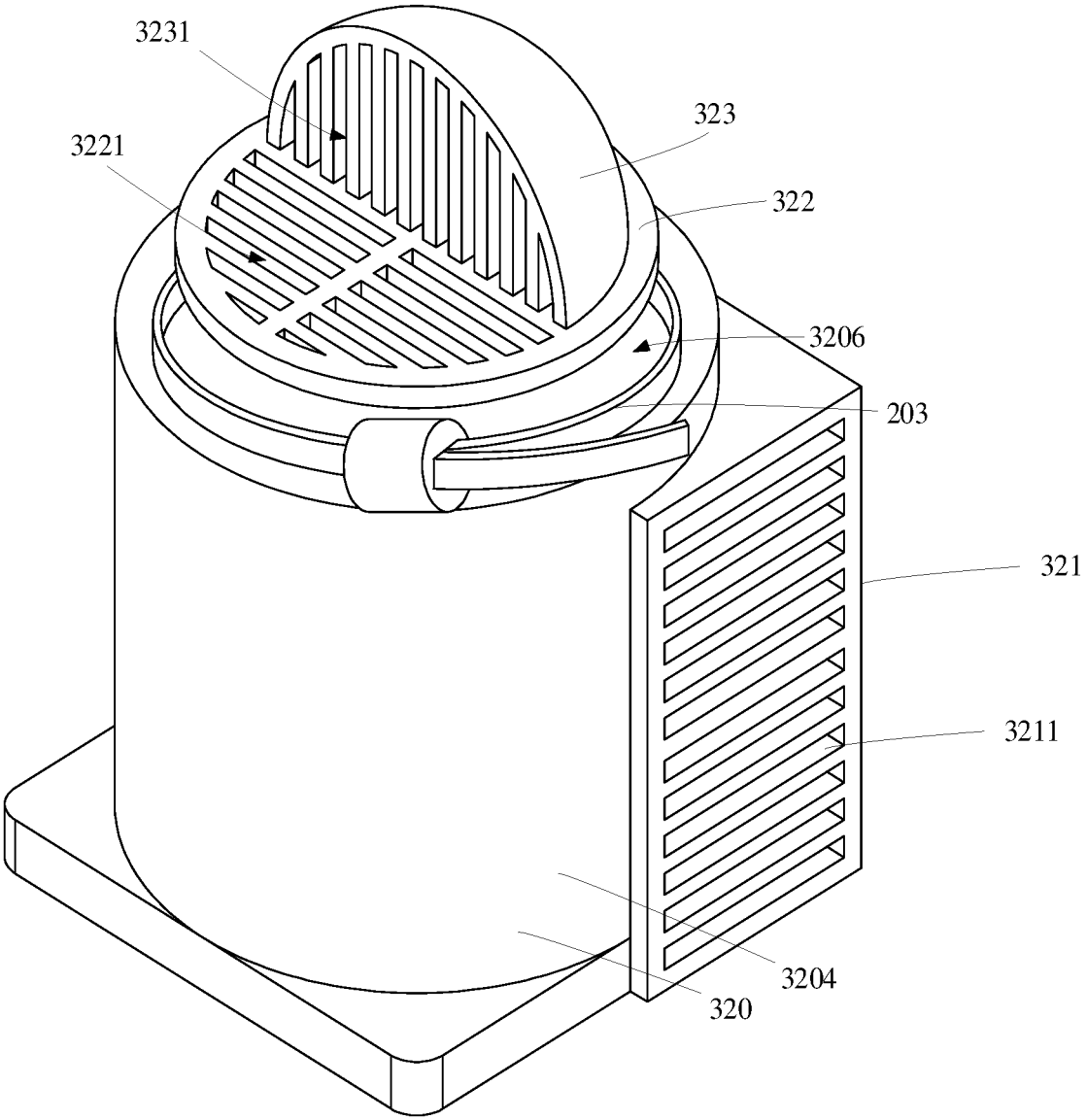
FIG. 18 is a structural schematic view of the second air blower according to another embodiment.

In another embodiment, as shown in FIG. 18, the air outlet portion 321 of second air blower 32 surround a part of the cylindrical body 3204 of the housing 320, an extension direction of the outlet 3211 is perpendicular to the first direction. The air outlet portion 321 extends along the length direction of the housing 320.

An edge of the second air inlet 21 is connected with the second air blower 32 by a connecting member, the connecting member includes a connecting strip 204 and a fixing part 205 connected with a first end 2041 of the connecting strip 204, the connecting strip 204 and the fixing part 205 are configured to connect the second air blower 32 with the expandable member 20. In detail, the edge of the second air inlet 21 crimps to form a receiving portion 203, the receiving portion 203 is ring shaped and defines a receiving space 2030 and two opposite via holes 2031 communicated with the receiving space 2030, the second air blower 32 is partially received in the expandable member 20, in detail, the first air inlet portion 322 and the second air inlet portion 323 are both received in the expandable member 20, and the air outlet portion 321 is arranged outside the expandable member 20, the receiving portion 203 surrounds the fixing portion 3206, the connecting strip 204 is received in the receiving portion 203 and surrounds the fixing portion 3206, and a second end 2042 of the connecting strip 204 is inserted in the through hole 2051 of the fixing part 205 to fix the second air blower 32 with the expandable member 20. When the body 10 and the expandable member 20 are inflated, the expandable member 20 can hold the second air blower 32 as the expandable member 20 is connected with the body 10.

The first air blower 31 and the second air blower 32 are intermittently actuated air blowers. An air drafting capability of the second air blower 32 is lower in pressure than that of the first air blower 31. The first air blower 31 has a power of about 5-300 W, preferably 110-300 W; and the second air blower 32 has a power of about 5-100 W, preferably 20-50 W. The power of the second air blower may be set according to actual needs, so as to adjust the deflation rate of the expandable member 20, further to adjust a deformation rate of the primary portion 11 and/or the secondary portion 12.

The primary portion 11 further defines at least one air outlet 112. The inflatable doll 100 further includes at least one sealing plug 13 configured to open or airtightly seal the air outlet 112.

The secondary portion 12 includes at least one up and down moving part and at least one left and right moving part, the up and down moving part of the secondary portion 12 includes the neck, the arm, the leg, the jaw, and the tail, and the left and right moving part of the secondary portion 12 includes the neck, the arm, the leg, the belly, and the tail. It should be understood that, the left and right moving part can also be controlled to move up and down, and up and down moving part can also be controlled to move left and right.

The primary portion 11 includes at least one up and down moving part and at least one left and right moving part, the up and down moving part of the primary portion 11 includes the neck, the arm, the leg, the jaw, and the tail, and the left and right moving part of the primary portion 11 includes the neck, the arm, the leg, the belly, and the tail. It should be understood that, the left and right moving part can also be controlled to move up and down, and up and down moving part can also be controlled to move left and right.

In the technical solution of the present disclosure, the first air blower 31 is received in the primary portion 11 and adjacent to the first air inlet 111, the first air blower 31 may direct the external air into the primary portion 11 through the first air inlet 111, to inflate the primary portion 11 and the secondary portion 12. The air in the primary portion 11 and the secondary portion 12 flows into the expandable member 20 through the second air inlet 21, to inflate the expandable member 20. The inflated expandable member 20 can hold the body 10 in an upright state. The second air blowers 32 are intermittently actuated, so that the second air blowers 32 can intermittently lead out the air in the expandable members 20 independently or synchronously, so as to move the primary portion 11 and/or the secondary portion 12. After the second air blowers 32 stop working, the air in the primary portion 11 and the secondary portion 12 flows into the expandable members 20 to inflate the expandable members 20, and the inflated expandable member 20 can deform to move the primary portion 11 and/or the secondary portion 12 again under the action of the second air blowers 32. In this way, the primary portion 11 and/or the secondary portion 12 is intermittently inflated or deflated, to move the primary portion 11 and/or the secondary portion 12. This cycle repeats, different portions of the body 10 can move up and down, and/or move right and left, forming a set of dynamic movements to attract customers.

Figure 2:
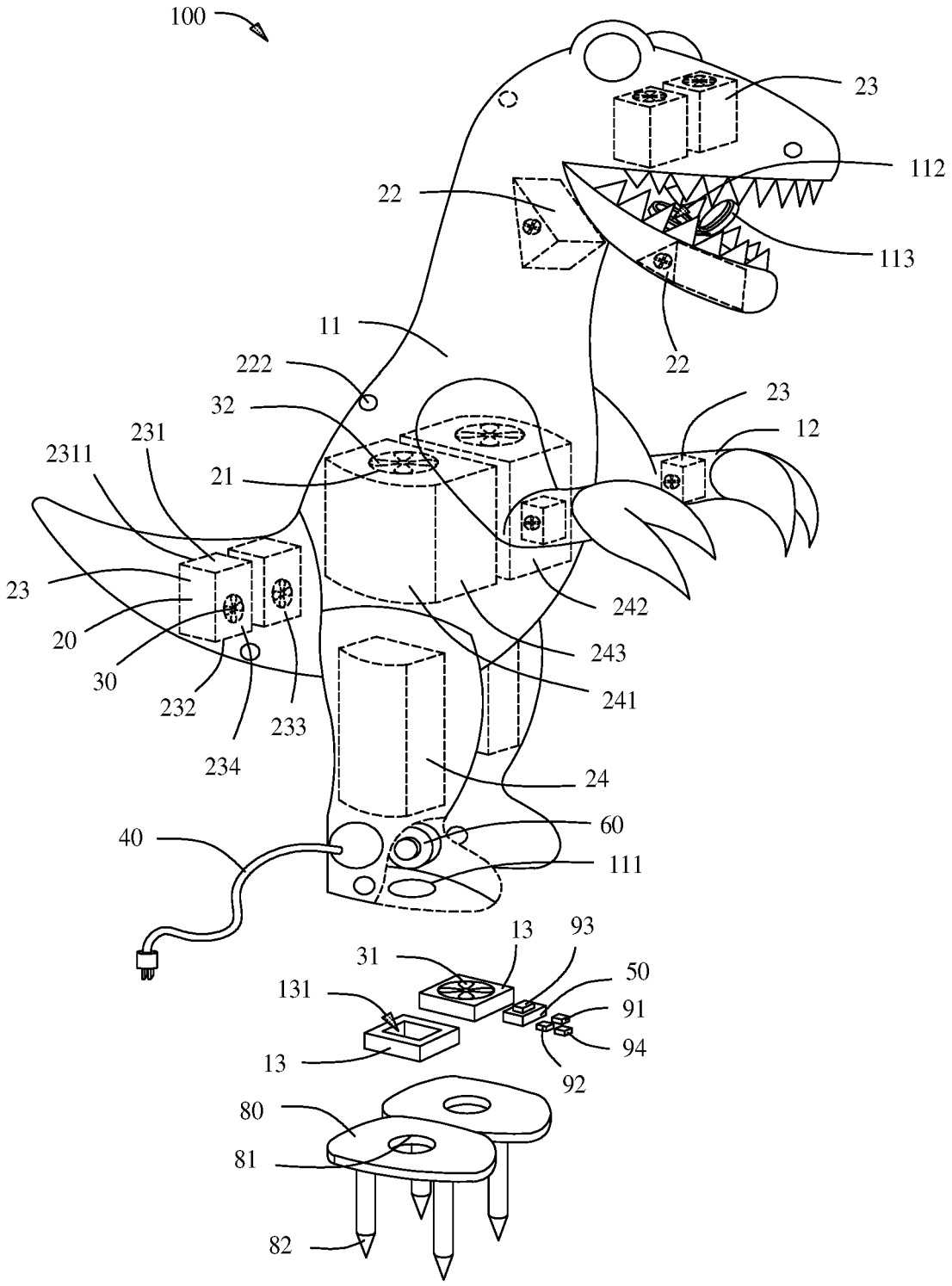
FIG. 2 is an exploded view of the inflatable doll in FIG. 1.
Figure 3:
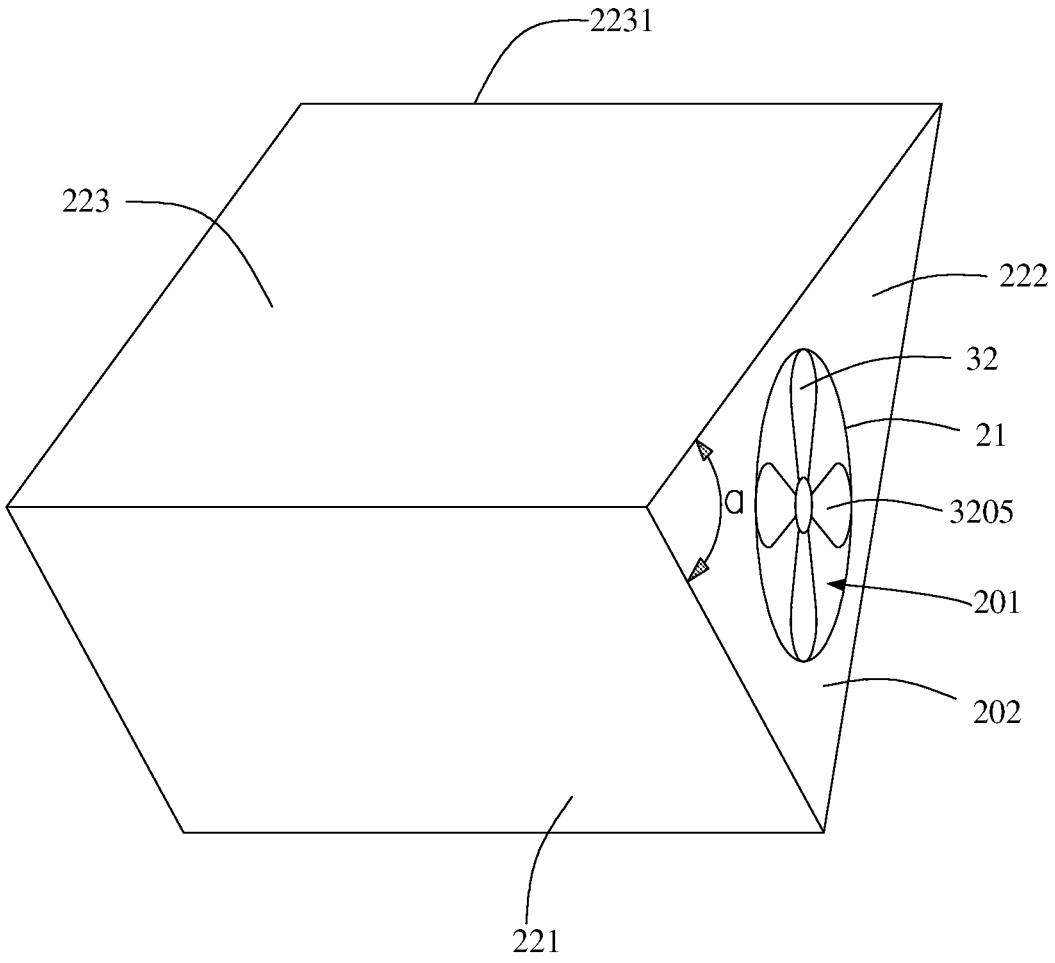
FIG. 3 is a structural schematic view of a first expandable member of the inflatable doll in FIG. 2.

Referring to FIGS. 2 and 3, the expandable member 20 includes at least one first expandable member 22 having a substantially triangular prism shape in the inflated state. The at least one first expandable member 22 is received in the primary portion 11 and/or the at least one secondary portion 12, and connected with the primary portion 11 and/or the at least one secondary portion 12. A portion of the first expandable member 22 is sewed with or glued with the primary portion 11 or the at least one secondary portion 12.

The first expandable member 22 includes a bottom surface 221, two opposite triangular surfaces 222 connected with two sides of the bottom surface 221 respectively, and two parallelogram surfaces 223 connected with the bottom surface 221 and the triangular surfaces 222. An area of a cross section of the first expandable member 22 is gradually decreased in a direction from the bottom surface 221 to the connecting edge 2231. When the first expandable member 22 is inflated, an angle $\alpha$ formed by the bottom surface 221 and the parallelogram surface 223 is about 30-60°. For example, the angle $\alpha$ is 30°, 40°, 50°, or 60°. The second air blower 32 is arranged on the bottom surface 221, the triangular surfaces 222 or the parallelogram surface 223. In one embodiment, at least one of the bottom surface 221, the triangular surface 222, and the parallelogram surface 223 is sewed with or glued with the primary portion 11 or the at least one secondary portion 12. In another embodiment, at least one edge of the first expandable member 22 is sewed with or glued with the primary portion 11 or the at least one secondary portion 12. The second air blower 32 is mounted on the surface of the first expandable member 22 which is not sewed with or glued with the body 10.

At least one surface of the first expandable member 22 is a flat surface or a curved surface. In one embodiment, the bottom surface 221 is flat or curved. In another embodiment, the triangular surface 222 is flat or curved. In a further embodiment, the parallelogram surface 223 is flat or curved.

The two parallelogram surfaces 223 are connected with each other, to form a connecting edge 2231, the connecting edge 2231 of the two parallelogram surfaces 223 is sewed or glued with the primary portion 11 or the at least one secondary portion 12, to support the primary portion 11 or the at least one secondary portion 12.

The expandable member 20 includes a plurality of first expandable members 22, the first expandable members 22 are received in the primary portion 11 and/or the at least one secondary portion 12, and connected with the primary portion 11 and/or the at least one secondary portion 12.

In one embodiment, the first expandable member 22 is received in the up and down moving part of the primary portion 11 or the at least one secondary portion 12, and connected with the up and down moving part of the primary portion 11 or the at least one secondary portion 12, for bringing the up and down moving part of the primary portion 11 or the at least one secondary portion 12 to move up and down. In detail, the up and down moving part of the primary portion 11 or the at least one secondary portion 12 includes the neck, the jaw, the arm, the leg, and the tail.

In another embodiment, the first expandable members 22 are received in the up and down moving parts of the primary portion 11 or the at least one secondary portion 12, and connected with the up and down moving parts of the primary portion 11 or the at least one secondary portion 12. In detail, the up and down moving parts of the primary portion 11 or the at least one secondary portion 12 include at least two selected from the jaw, the neck, the arm, the leg, and the tail.

Specifically, there are at least two expandable members 22 arranged in the primary portion 11 and arranged adjacent to each other at a same height, the second air blowers 32 corresponding to the at least two expandable members 22 arranged in the primary portion 11 are arranged towards the same direction or arranged towards different directions; there are at least two expandable members 22 arranged in the secondary portion 12 and arranged adjacent to each other at a same height, the second air blowers 32 corresponding to the at least two expandable members 22 arranged in the secondary portion 12 are arranged towards the same direction or arranged towards different directions; there are two expandable members 22 respectively arranged in two secondary portions 12 and arranged adjacent to each other at a same height, the second air blowers 32 corresponding to the two expandable members 22 arranged in the two secondary portions 12 are arranged towards the same direction or arranged towards different directions.

The first expandable member 22 may be deflated two to eight times per minute under an action of the second air blower 32. Specifically, the first expandable members 22 are deflated in the same rate or different rates.

In the technical solution of the present disclosure, the at least one first expandable member 22 having a triangular prism shape is received in the primary portion 11 and/or the at least one secondary portion 12, and connected with the primary portion 11 and/or the at least one secondary portion 12. When the at least one first expandable member 22 is filled with air, the inflated first expandable member 22 can hold the primary portion 11 and/or the at least one secondary portion 12 in the upright state. When the second air blower 31 corresponding to the first expandable member 22 works, the second air blower 31 leads out the air in the at least one first expandable member 22, the at least one first expandable member 22 brings the primary portion 11 and/or the at least one secondary portion 12 move downwards. When the second air blower 31 corresponding to the first expandable member 22 stops working, the air in the body 10 flows into the at least one first expandable member 22 to inflate the at least one first expanable member 22, the inflated first expandable member 22 can hold the primary portion 11 and/or the at least one secondary portion 12 in the upright state again. This cycle repeats, the primary portion 11 and/or the at least one secondary portion 12 can move up and down. Further, the angle is configured to limit a downward displacement of the at least one first expandable member 22, and the second air blower 32 is configured to adjust the deflation rate of the expandable member 20, further to adjust the deformation rate of the primary portion 11 and/or the secondary portion 12.

Figure 4:
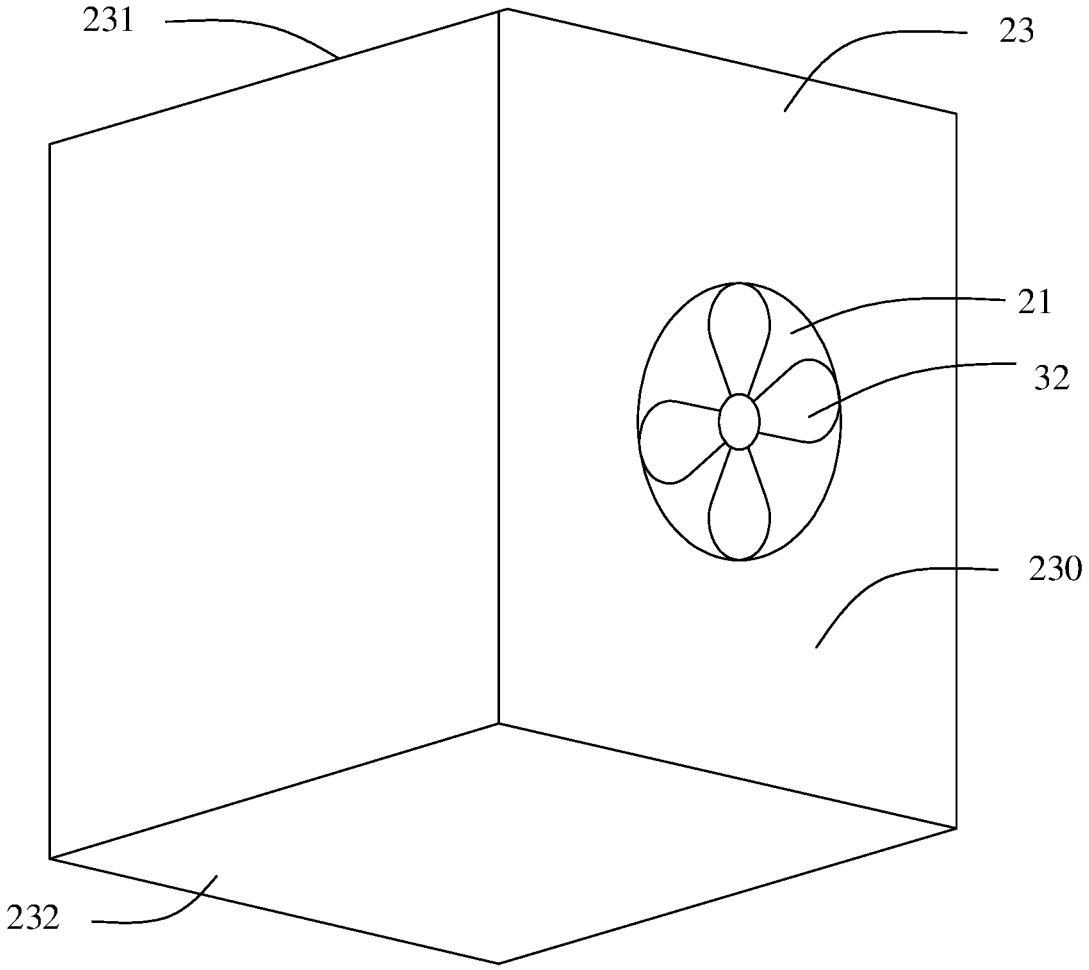
FIG. 4 is a structural schematic view of a second expandable member of the inflatable doll in FIG. 2.

Referring to FIGS. 2 and 4, the expandable member 20 includes at least one second expandable member 23 having a substantially hexahedral shape, the at least one second expandable member 23 is received in the primary portion 11 and/or the at least one secondary portion 12 and connected with the primary portion 11 and/or the at least one secondary portion 12.

A shape of the second expandable member 23 is substantially a cube, a parallelepiped, or an irregular hexahedron. At least one surface of the second expandable member 23 is flat or curved. A portion of the second expandable member 23 is sewed with or glued with the primary portion 11 or the at least one secondary portion 12.

In one embodiment, a top surface 231 of the hexahedral shaped second expandable member 23 is connected with the primary portion 11 or the at least one secondary portion 12. In detail, the top surface 231 of the hexahedral shaped second expandable member 23 is sewed or glued with the primary portion 11 or the at least one secondary portion 12. In another embodiment, a bottom surface 232 of the hexahedral shaped second expandable member 23 is connected with the primary portion 11 or the at least one secondary portion 12. In detail, the bottom surface 232 of the hexahedral shaped second expandable member 23 is sewed or glued with the primary portion 11 or the at least one secondary portion 12. In a further embodiment, an edge 2311 of the top surface 231 of the hexahedral shaped second expandable member 23 is sewed or glued with the primary portion 11 or the at least one secondary portion 12. The second air blower 32 is arranged on the top surface 231, the bottom surface 232 or a side surface 230.

In one embodiment, the at least one second expandable member 23 includes a plurality of second expandable members 23, which are received in the primary portion 11 and/or the at least one secondary portion 12 and connected with the primary portion 11 and/or the at least one secondary portion 12.

In one embodiment, the second expandable member 23 may be received in the up and down moving part of the primary portion 11 or the at least one secondary portion 12, and connected with the up and down moving part of the primary portion 11 or the at least one secondary portion 12, for bringing the up and down moving part of the primary portion 11 or the at least one secondary portion 12 to move up and down. In detail, the up and down moving part of the primary portion 11 or the at least one secondary portion 12 includes the jaw, the neck, the arm, the leg, and the tail. In detail, the second expandable members 23 may be received in the up and down moving parts of the primary portion 11 or the at least one secondary portion 12, and connected with the up and down moving parts of the primary portion 11 or the at least one secondary portion 12, for bringing the up and down moving parts of the primary portion 11 or the at least one secondary portion 12 to move up and down. The up and down moving parts of the primary portion 11 or the at least one secondary portion 12 include at least two selected from the jaw, the neck, the arm, the leg, and the tail.

In the technical solution of the present disclosure, the at least one second expandable member 23 having a substantially hexahedral shape is received in the primary portion 11 and/or the at least one secondary portion 12 and connected with the primary portion 11 and/or the at least one secondary portion 12. When the at least one second expandable member 23 is filled with air, the inflated second expandable member 23 can hold the primary portion 11 and/or the at least one secondary portion 12 in the upright state. When the second air blower 31 corresponding to the second expandable member 23 works, the second air blower 31 leads out the air in the at least one second expandable member 23, the at least one second expandable member 23 move the primary portion 11 and/or the at least one secondary portion 12. When the second air blower 31 corresponding to the second expandable member 23 stops working, the air in the body 10 flows into the at least one second expandable member 23, the inflated second expandable member 23 can hold the primary portion 11 and/or the at least one secondary portion 12 in the upright state again. This cycle repeats, the primary portion 11 and/or the at least one secondary portion 12 can move up and down.

At least two second expandable members 23 may be received in the left and right moving part of the primary portion 11 or the at least one secondary portion 12, and connected with the left and right moving part of the primary portion 11 or the at least one secondary portion 12, for bringing the left and right moving part of the primary portion 11 or the at least one secondary portion 12 to move left and right. In detail, the left and right moving part of the primary portion 11 or the at least one secondary portion 12 includes the belly, the neck, the arm, the leg, and the tail.

In one embodiment, two second expandable members 23 are received in the tail and connected with the tail. A right expandable member 233 deflates and brings the tail to move towards right, then the air in the body 10 flows back into the right expandable member 233 to hold the belly in the upright state. A left expandable member 234 of the two second expandable members 23 deflates and brings the tail to move towards left, then the air in the body 10 flows back into the left expandable member 234 of the two second expandable members 23 to hold the tail in the upright state. This cycle repeats, the belly may move right and left. The right expandable member 233 is parallel with the left expandable member 234. A distance between the right expandable member 233 and the left expandable member 234 is about 10-50 cm.

The second expandable member 23 may be deflated two to eight times per minute under the action of the second air blower 32.

The right expandable member 233 is contracted for ten to thirty seconds under the action of the second air blower 32, then the left expandable member 234 may be contracted for ten to thirty seconds under the action of another second air blower 32. The two second air blowers 32 may be intermittently actuated. This cycle repeats, the tail may move right and left.

Figure 5:
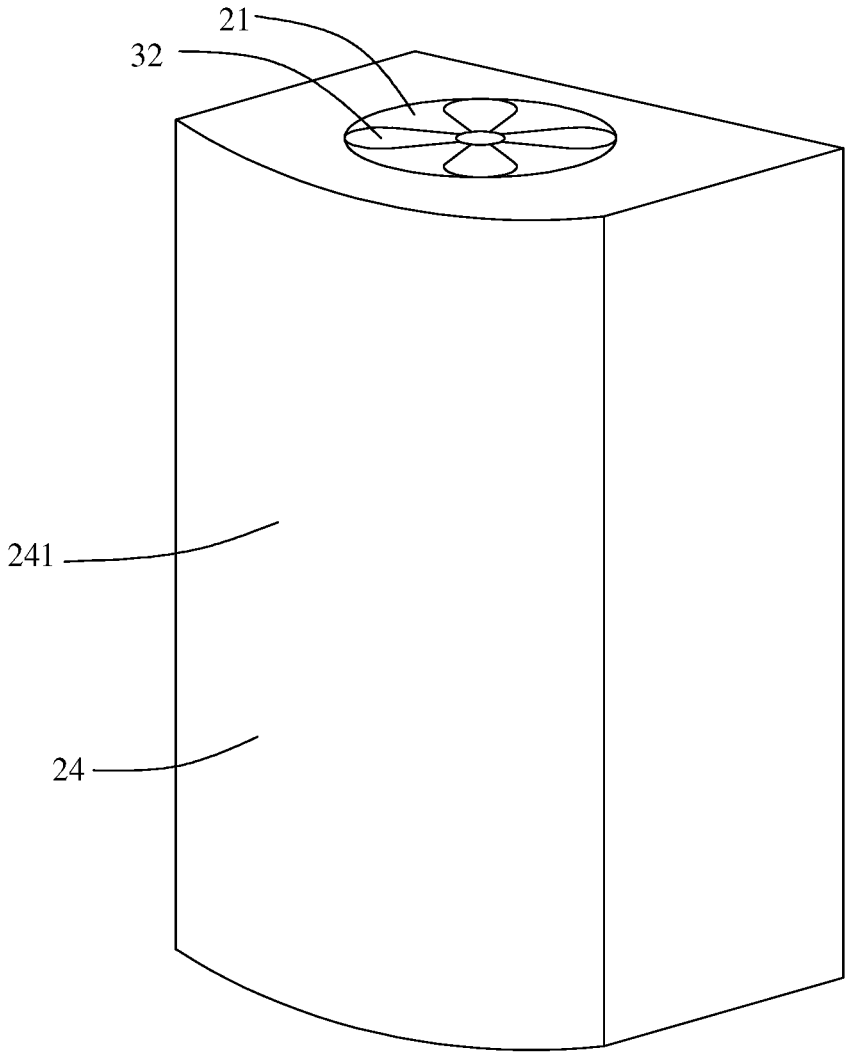
FIG. 5 is a structural schematic view of a third expandable member of the inflatable doll in FIG. 2.

Referring to FIGS. 2 and 5, the expandable member 20 includes at least one third expandable member 24 connected with the primary portion 11 and/or the at least one secondary portion 12, the at least one third expandable member 24 includes a substantially irregular hexahedral shape having at least one arc surface 242. At least one surface of the irregular hexahedron is flat or curved.

The at least one third expandable member 24 is sewed with or glued with the primary portion 11 or the at least one secondary portion 12. In at least one embodiment, a side surface 241 of the third expandable member 24 is sewed or glued with the primary portion 11 or the at least one secondary portion 12. The side surface 241 is matched in shape with an inner surface of the primary portion 11 or the at least one secondary portion 12. In at least one embodiment, the at least one third expandable member 24 includes a plurality of third expandable members 24, the third expandable members 24 are received in the primary portion 11 and/or the at least one secondary portion 12, and connected with the primary portion 11 and/or the at least one secondary portion 12. The second air blower 32 is arranged on the side surface 241, the bottom surface or the top surface.

The third expandable member 24 may be received in the up and down moving part of the primary portion 11 or the at least one secondary portion 12, and connected with the up and down moving part, for bringing the up and down moving part to move up and down. The up and down moving part includes the jaw, the neck, the arm, the leg, and the tail.

In at least one embodiment, the third expandable members 24 may be received in the up and down moving parts of the primary portion 11 or the at least one secondary portion 12, and connected with the up and down moving parts of the primary portion 11 or the at least one secondary portion 12, for bringing the up and down moving parts of the primary portion 11 or the at least one secondary portion 12 to move up and down. In detail, the up and down moving parts of the primary portion 11 or the at least one secondary portion 12 include at least two selected from the jaw, the neck, the arm, the leg, and the tail.

In at least one embodiment, the third expandable member 24 may be deflated two to eight times per minute under the action of the second air blower 32.

In the technical solution of the present disclosure, the at least one third expandable member 24 has a substantially irregular hexahedral shape, the irregular hexahedral shape has at least one arc surface 242, the at least one third expandable member 24 is received in the primary portion 11 and/or the at least one secondary portion 12 and connected with the primary portion 11 and/or the at least one secondary portion 12. When the at least one third expandable member 24 is filled with air, the inflated third expandable member 24 can hold the primary portion 11 and/or the at least one secondary portion 12 in the upright state. When the second air blower 31 corresponding to the third expandable member 24 works, the second air blower 31 leads out the air in the at least one third expandable member 24, the at least one third expandable member 24 brings the primary portion 11 and/or the at least one secondary portion 12 move downwards. When the second air blower 31 corresponding to the third expandable member 24 stops working, the air in the body 10 flows into the at least one third expandable member 24, the inflated third expandable member 24 can hold the primary portion 11 and/or the at least one secondary portion 12 in the upright state again. This cycle repeats, the primary portion 11 and/or the at least one secondary portion 12 can move up and down.

At least two third expandable members 24 may be received in the left and right moving part of the primary portion 11 or the at least one secondary portion 12, for bringing the left and right moving part to move left and right. In detail, the left and right moving part includes the belly, the neck, the arm, the leg, and the tail.

In at least one embodiment, two third expandable members 24 are received in the belly and connected with the belly. A right expandable member 242 deflates and brings the belly to move towards right, then the air in the body 10 flows back into the right expandable member 242 to hold the belly in the upright state. A left expandable member 243 parallel with the right expandable member 242 deflates and brings the belly to move towards left, then the air in the body 10 flows back into the left expandable member 243 to hold the belly in the upright state. This cycle repeats, the belly may move right and left. The right expandable member 242 may be contracted for ten to thirty minutes under the action of one second air blower 32, then the left expandable member 243 may be contracted for ten to thirty minutes under the action of another second air blower 32. The two second air blowers 32 may be intermittently actuated. This cycle repeats, the belly may move right and left.

Figure 6:
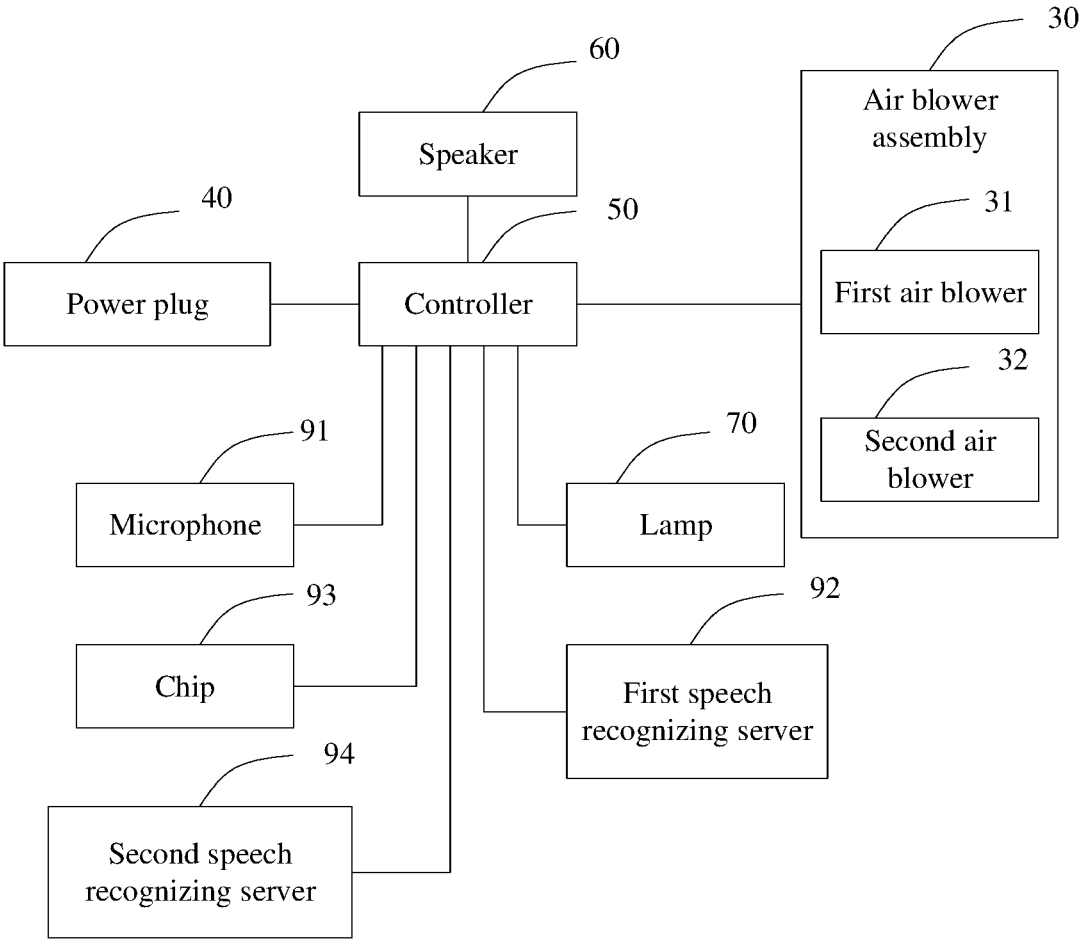
FIG. 6 is a structural block diagram of a controller, a power plug, a lamp, a speaker, and an air blower assembly of the inflatable doll in FIG. 1.
Figure 7:
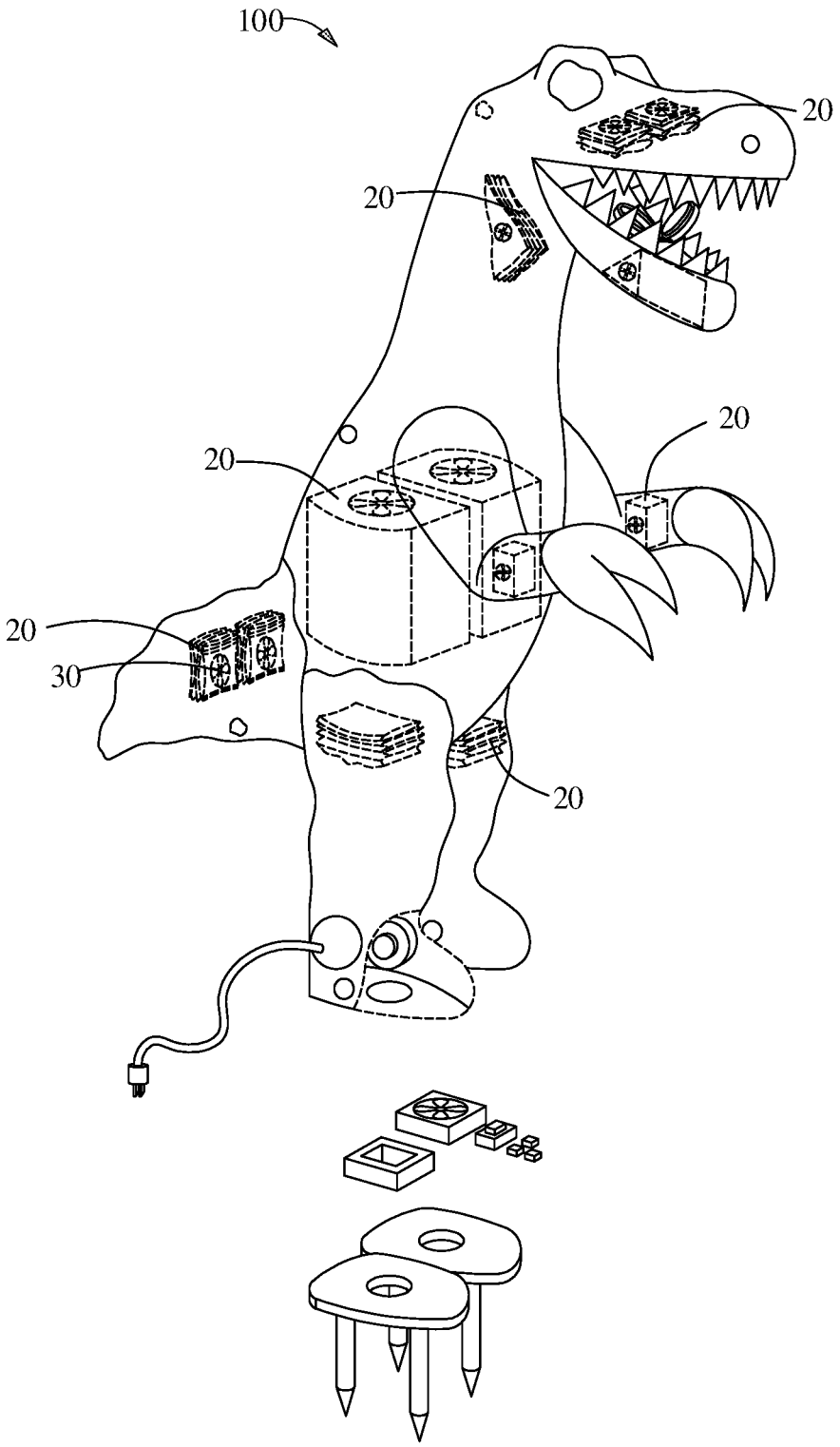
FIG. 7 is a structural schematic view of the inflatable doll in FIG. 1 in a deflated state.
Figure 8:
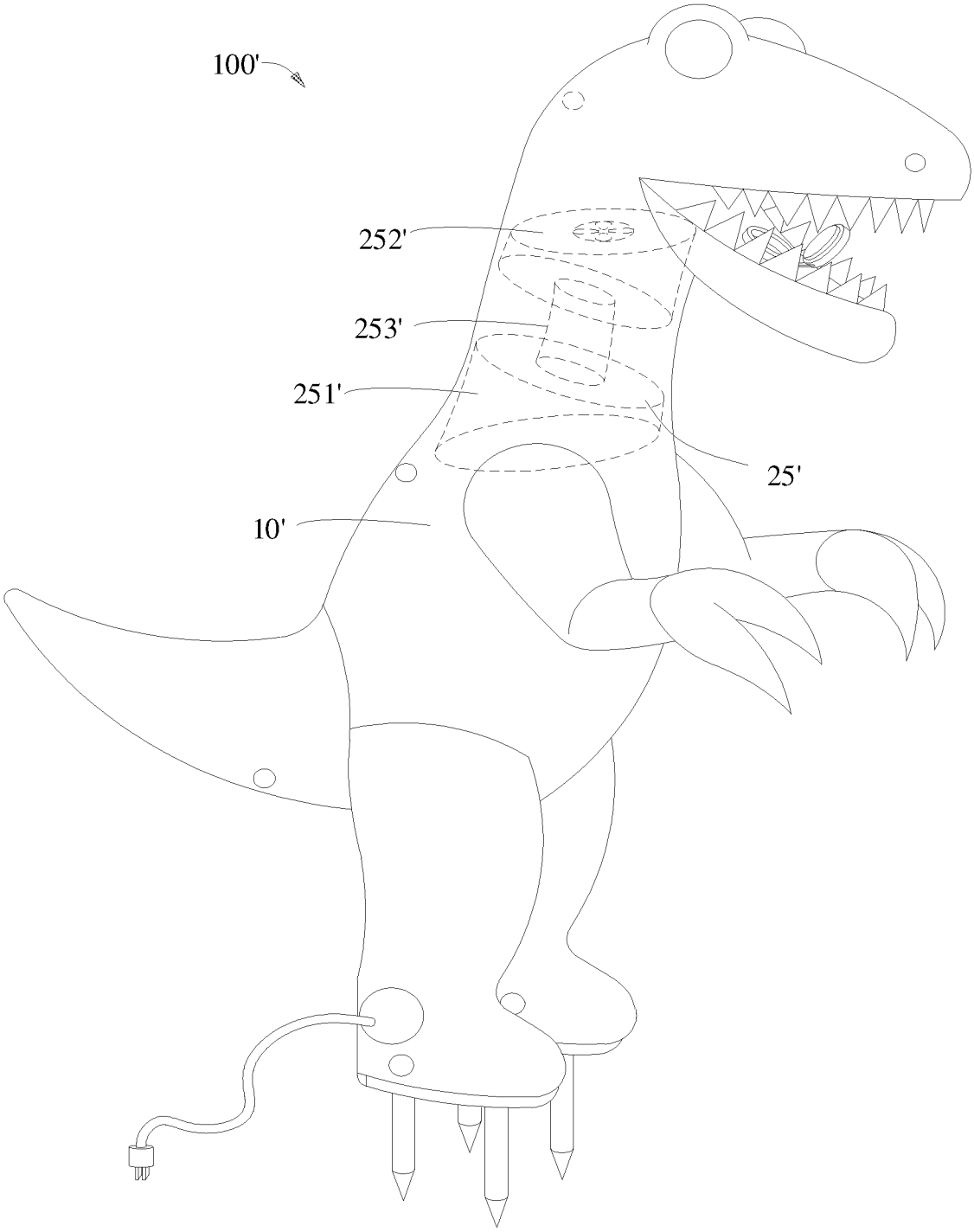
FIG. 8 is a structural schematic view of an inflatable doll according to a second embodiment of the present disclosure.
Figure 9:
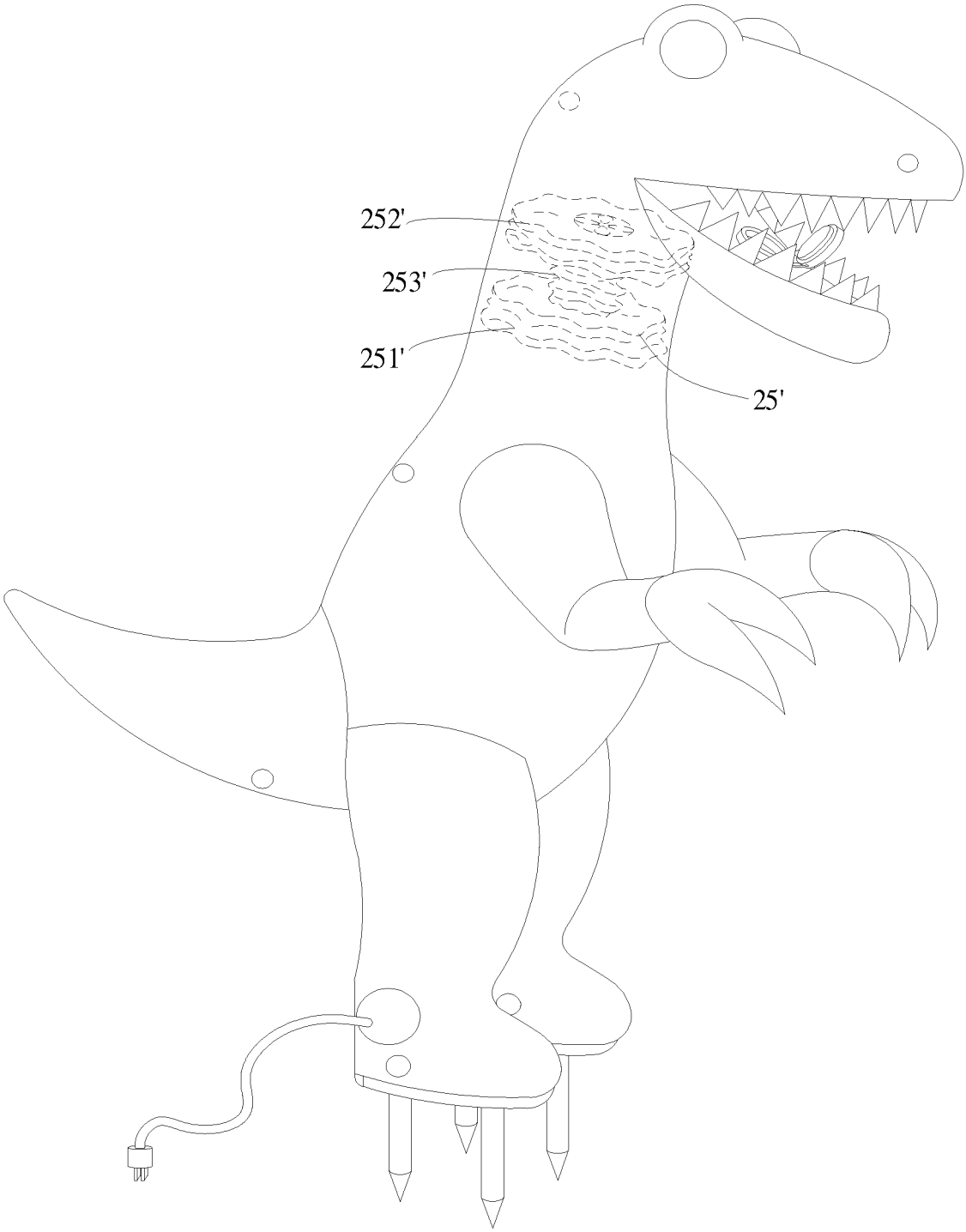
FIG. 9 is a structural schematic view of the inflatable doll in FIG. 8 in a deflated state.
Figure 10:
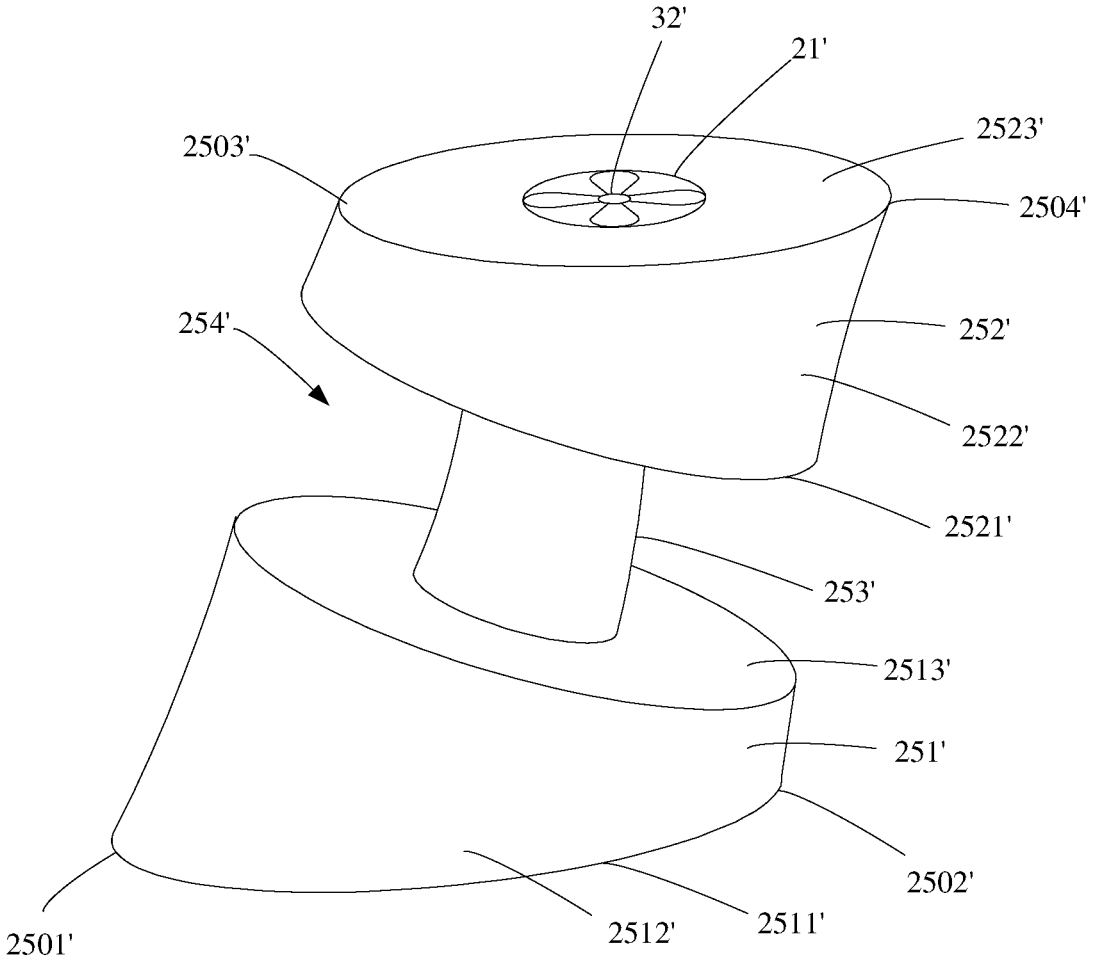
FIG. 10 is a structural schematic view of an expandable member of the inflatable doll in FIG. 8.
Figure 11:
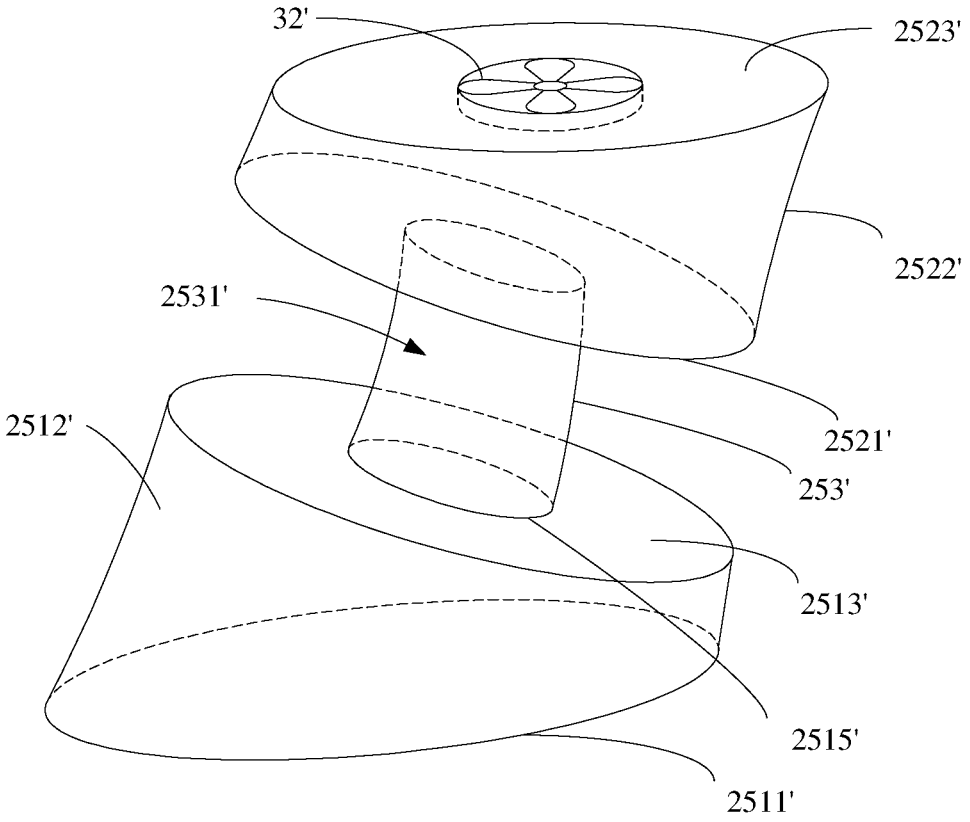
FIG. 11 is another structural schematic view of the expandable member in FIG. 10.

Referring to FIGS. 1, 2 and 6, the inflatable doll 100 further includes a power plug 40 arranged on the primary portion 11, and a controller 50 received in the primary portion 11, the power plug 40 and the controller 50 are both electrically connected with the air blower assembly 30. The controller 50 has an integrated circuit. The power plug 40 may be connected with an external power supply. The power plug 40 and the controller 50 are both electrically connected with the air blower assembly 30, for controlling operations of the first air blower 31 and the second air blower 32.

The inflatable doll 100 further includes a speaker 60 received in the primary portion 11 or the secondary portion 12, the speaker 60 is electrically connected with the controller 50. The speaker 60 is arranged in the primary portion 11 or the secondary portion 12, and can may play songs, stories, sounds of dinosaurs, etc. The controller 50 may adjust a deflation time and a deflation frequency of the expandable member 20, for bringing the body 10 to dance according to a rhythm of the music.

The inflatable doll 100 further includes at least one lamp 70 received in the primary portion 11 or the secondary portion 12, or arranged on an outer surface of the primary portion 11 or the secondary portion 12, the at least one lamp 70 is electrically connected with the controller 50. In at least one embodiment, the inflatable doll 100 includes a plurality of lamps 70. The lamp 70 may emit white light or color light. The lamp 70 may be a LED lamp.

In another embodiment, at least one lamp 70 is arranged on the outer surface of the primary portion 11 or the secondary portion 12, for attracting the customers.

The inflatable doll 100 further includes a microphone 91, a first speech recognizing server 92, a chip 93, and a second speech recognizing server 94 all received in the body 10. The microphone 91 is configured to collect a voice and transmit a voice signal to the controller 50. The first speech recognizing server 92 is electrically connected with the controller 50 and configured to recognize the voice signal and transmit a recognition result to the controller 50. The chip 93 is electrically connected with the controller and pre-storing vocabularies and configured to output a feedback to the controller according to the vocabularies. The second speech recognizing server 94 transmits the feedback to the speaker 60, to communicate with user.

The controller 50 processes the voice signal and transmits the processed voice signal to the first speech recognizing server 92, the first speech recognizing server 92 recognizes the processed voice signal, and transmits the recognition result to the controller 50. The controller 50 sends the recognition result to the chip 93, then the chip 93 output the feedback to the controller 50 according to the vocabularies. The controller 50 sends the feedback to the second speech recognizing server 94, then the second speech recognizing server 94 transmits the feedback to the speaker 60, to communicate with user. In this way, the inflatable doll 100 may intelligently communicate with user. The chip 93 may be arranged on the controller 50. The controller 50 is configured to send an instruction to the air blower assembly 30, the speaker 60, or the lamp 70, to control an operation of the air blower assembly 30, the speaker 60, or the lamp 70.

After receiving the voice signal, the controller 50 may send one instruction to the first air blower 31 to control the first air blower 31 to start working or stop working. After receiving the voice signal, the controller 50 may send one instruction to the second air blower 32 to control the second air blower 32 to start working or stop working. In detail, after the controller 50 receiving the voice signal, the controller 50 may send one instruction to the second air blower 32 to control the second air blower 32 to work intermittently. After the controller 50 receiving the voice signal, the controller 50 may send one instruction to the speaker 60 to control the speaker 60 to play songs, stories, sounds of dinosaurs, etc. After receiving the voice signal, the controller 50 may send one instruction to the lamp 70 to control the lamp 70 to emit light.

The inflatable doll 100 further includes a base 80 connected with the body 10 and the first air blower 31. The base 80 is attached to a bottom end of the primary portion 11, so that the body 10 is suspended above the ground. The base 80 defines a third air inlet 81 communicated with the first air inlet 111. The first air blower 31 is adjacent to the first air inlet 111 and the third air inlet 81. The base 80 further includes at least one foot 82 arranged on a surface of the base 80 opposite to the body 10. In detail, the base 80 includes a plurality of feet 82 spaced apart from each other, the feet 82 are arranged on the surface of the base 80 opposite to the body 10.

The inflatable doll 100 further includes a supporting element 13 arranged in the primary portion 11 and supported by the base 80, the supporting element 13 is connected with the first air blower 31. The supporting element 13 is arranged on the bottom end of the primary portion 11. The supporting element 13 defines a fourth air inlet 131, the fourth air inlet 131 is communicated with the third air inlet 81 and the first air inlet 111.

Referring to FIGS. 8-11, the present disclosure provides an inflatable doll 100' according to a second embodiment, the inflatable doll 100' is similar with the inflatable doll 100 in structure, and the differences between the two at least include: the expandable members includes at least one fourth expandable member 25' received in the body, the at least one fourth expandable member 25' includes a first expandable portion 251', a second expandable portion 252' and a connecting portion 253', the first expandable portion 251' is communicated with the second expandable portion 252' by the connecting portion 253'.

A cross section of the first expandable portion 251' or the second expandable portion 252' is substantially trapezoidal shaped. A cross section of the connecting portion 253' is substantially circular, square or irregular shaped.

In one embodiment, the connecting 253' is rigid and cannot deform. In another embodiment, the connecting portion 253' is flexible, so the connecting portion 253' is also expandable and deformable to move the body 10', a cross-sectional area of the first expandable portion 251' is one to three times that of the connecting portion 253', or a cross-sectional area of the second expandable portion 252' is one to three times that of the connecting portion 253', so that a notch 254' is formed between the first expandable portion 251' and the second expandable portion 252'. The first expandable portion 251' and the second expandable portion 252' can deform into the notch 254', so that the body 10' can deform rapider compared with the first to third expandable members, and the deformation amount of the body 10' is greater than that of the body 10 in the first embodiment. Specifically, the body 10' can move down more distance in less time compared with the first to third expandable members.

The first expandable portion 251' includes a first surface 2511' opposite to the connecting portion 253', the second expandable 252' includes a second surface 2523' opposite to the connecting portion 253', the first surface 2511' is parallel with the second surface 2523', the first surface 2511' and the second surface 2523' are inclined towards a same direction to increase a size of the notch 254'. In detail, the first surface 2511' includes a first end 2501' and a second end 2502', the second surface 2523' includes a third end 2503' and a fourth end 2504', a first inclining direction from the first end 2501' to the second end 2502' is parallel with a second inclining direction from the third end 2503' to the fourth end 2504'. In this way, a distance between the first end 2501' and the fourth end 2504' is larger, and the first end 2501' and the fourth end 2504' can move the body 10' to deform more when the first end 2501' and the fourth end 2504' are connected with the body 10'.

The second surface 2523' defines the second air inlet 21', and the second air blower 32' is at least partially received in the second air inlet 21'. The first surface 2511' faces towards foot of the body, and the second surface 2523' faces towards head of the body.

The first expandable portion 251' further includes a third surface 2513', the second expandable portion 252' further includes a fourth surface 2521', each of the third surface 2513' and the fourth surface 2521' defines a connecting hole 2515', the connecting portion 253' defines a through hole 2531', the first expandable portion 251' is communicated with the second expandable portion 252' by the connecting holes 2515' and the through hole 2531'. The first expandable portion 251' further includes a fifth surface 2512' connected between the first surface 2511' and the third surface 2513', the second expandable portion 252' further includes a sixth surface 2522' connected between fourth surface 2521' and the second surface 2523'.

It should be understood that, the expandable members in the second embodiment includes at least one fourth expandable member 25' and the the first to third expandable members. Or the expandable members in the second embodiment only includes the fourth expandable members 25'.

Figure 12:
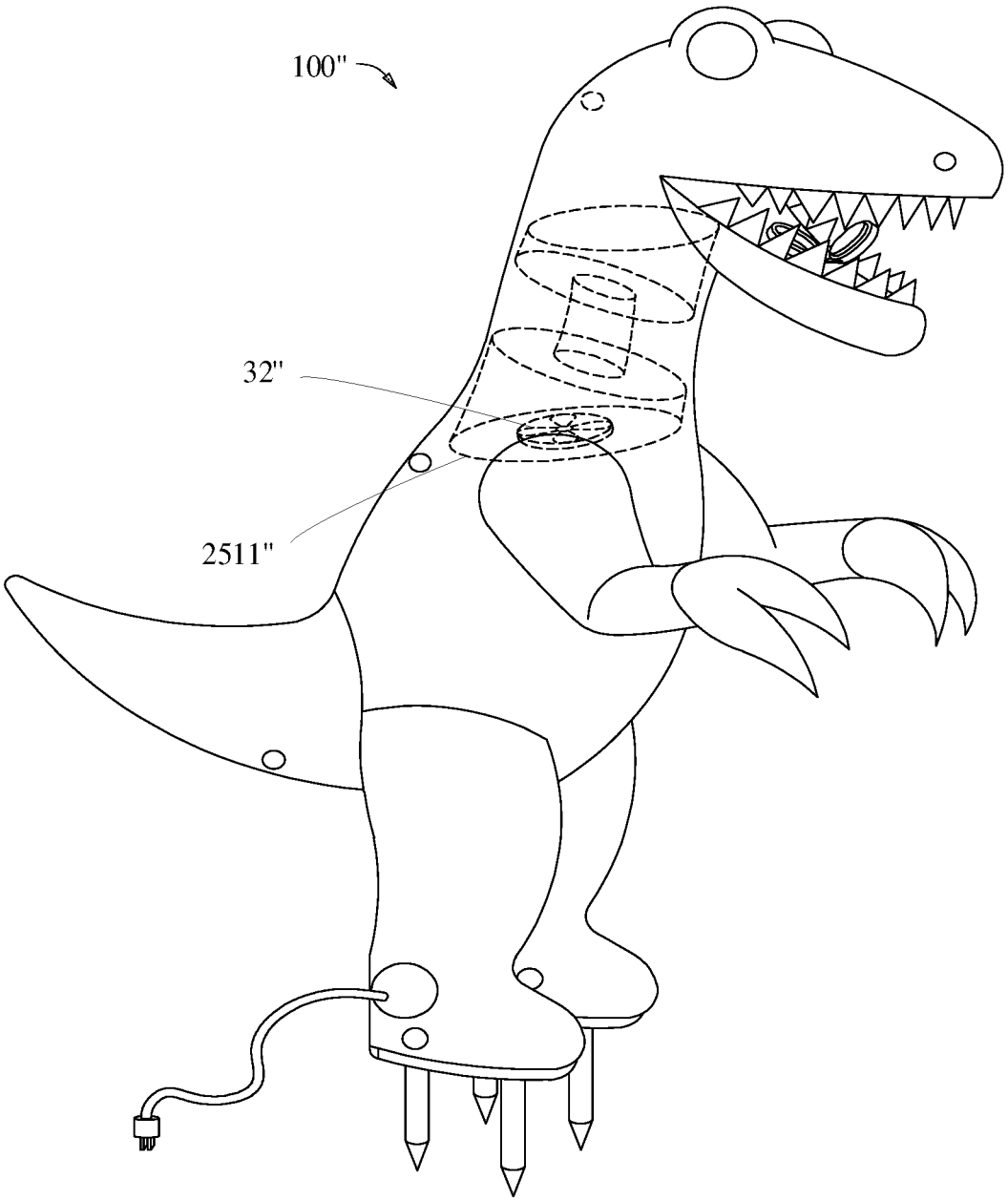
FIG. 12 is a structural schematic view of an inflatable doll according to a third embodiment of the present disclosure.
Figure 13:
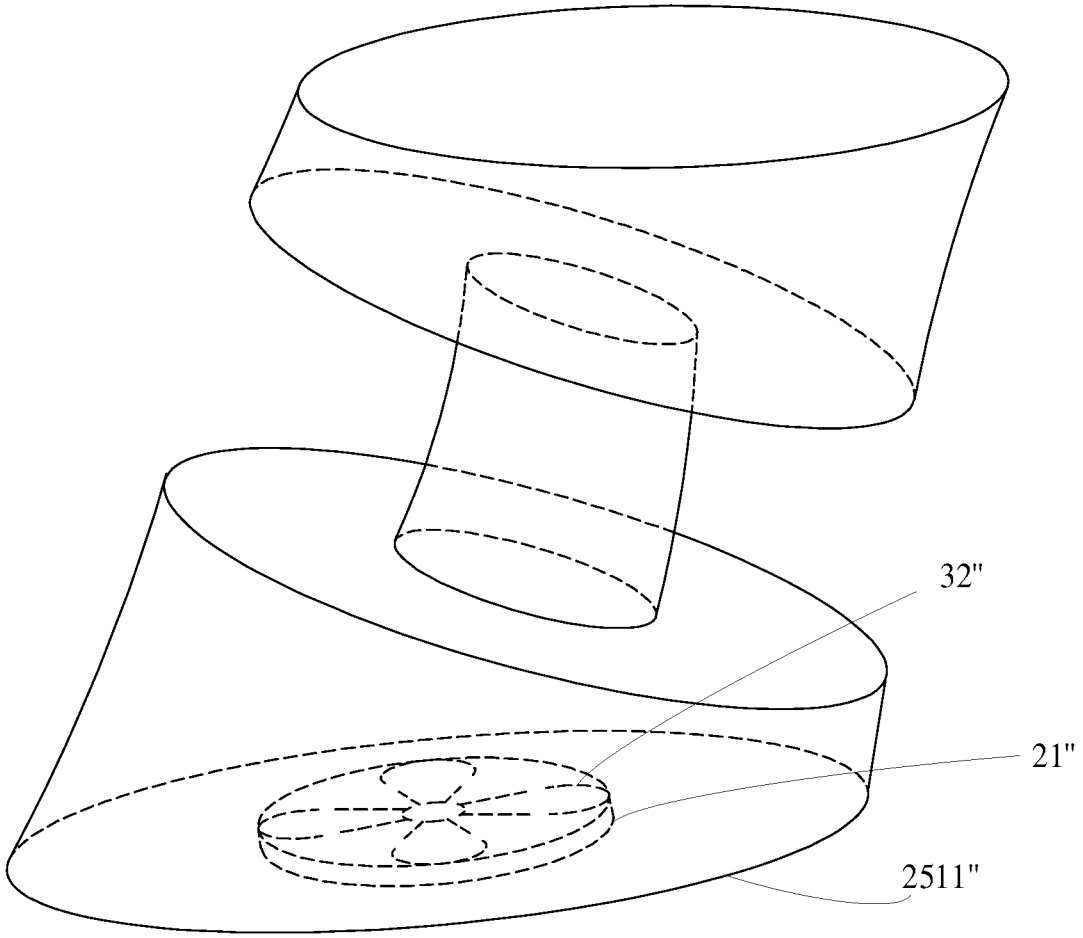
FIG. 13 is a structural schematic view of an expandable member of the inflatable doll in FIG. 12.
Figure 14:
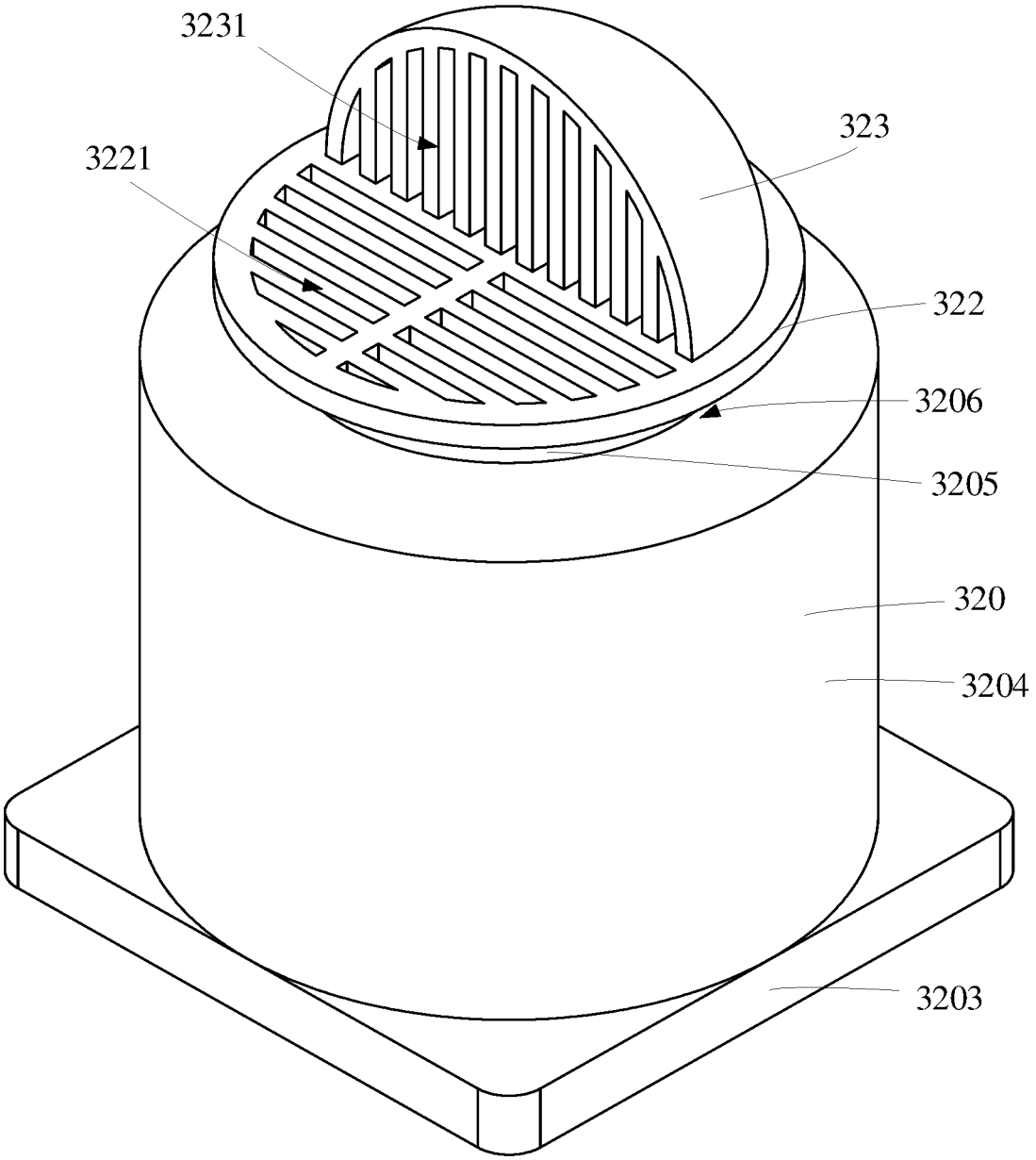
FIG. 14 is a structural schematic view of the second air blower in FIG. 2.
Figure 15:
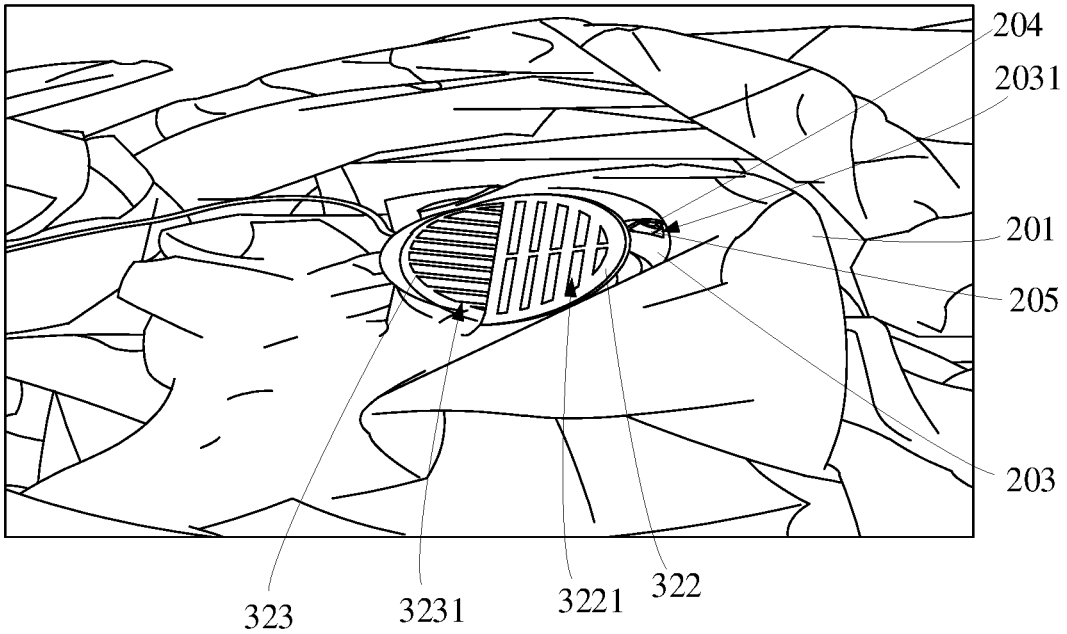
FIG. 15 is a structural schematic view of the second air blower and a portion of the expandable member in FIG. 2.
Figure 16:
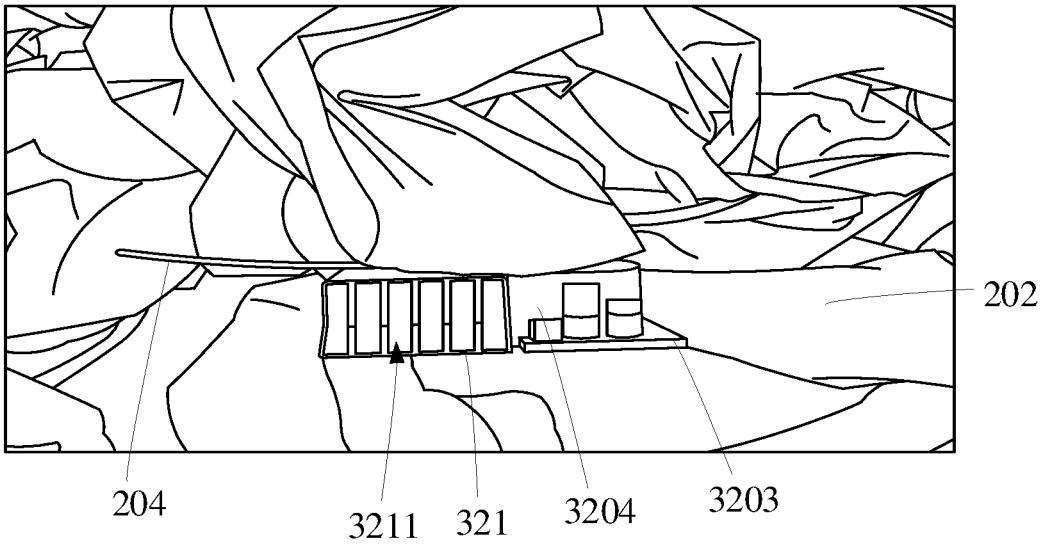
FIG. 16 is another structural schematic view of the second air blower and a portion of the expandable member in FIG. 2.
Figure 17:
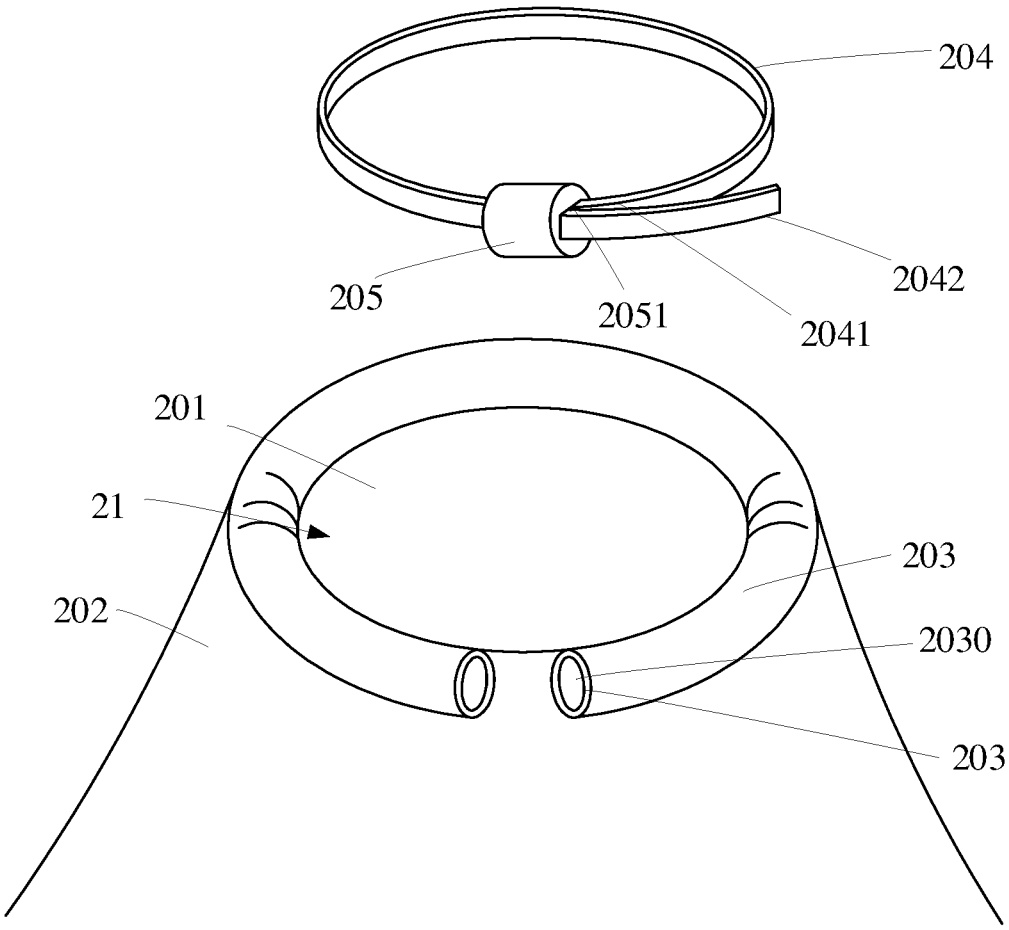
FIG. 17 is a further structural schematic view of a connecting member and a part of the expandable member of the inflatable doll.

Referring to FIGS. 12-13, the present disclosure provides an inflatable doll 100" according to a third embodiment, the inflatable doll 100" is similar with the inflatable doll 100' in structure, and the difference between the two at least includes: the first surface 2511" defines the second air inlet 21", and the second air blower 32" is at least partially received in the second air inlet 21".

The above description is merely some embodiments. It should be noted that for one with ordinary skills in the art, improvements can be made without departing from the concept of the present disclosure, but these improvements shall fall into the protection scope of the present disclosure.

What is claimed is:

1. An inflatable doll, comprising:

a body, having a first air inlet and a first air cavity communicated with the first air inlet;

a plurality of expandable members, completely received in the first air cavity and connected with the body, each expandable member defining a second air inlet and a second air cavity communicated with the second air inlet;

a controller; and an air blower assembly, comprising:

a first air blower, arranged adjacent to the first air inlet, the first air blower is configured to introduce air into the first air cavity through the first air inlet to inflate the body and into the second air cavity of each of the plurality of expandable members through the second air inlet; and a plurality of second air blowers, received in the first air cavity and each of the plurality of second air blowers being communicated with the second air inlet of a respective one of the plurality of expandable members, each second air blower being configured to direct air out of the second air inlet of the respective one corresponding expandable member, so that the expandable members are deformed to move the body;

wherein:

the controller is electrically connected to the first air blower and the plurality of second air blowers; and in response to receiving a voice signal, the controller is configured to control the first blower to start or stop inflating the first air cavity and to adjust a deflation time and a deflation frequency of each of the plurality of second air blowers to cause the entire body to perform movements according to a rhythm of a music.

2. The inflatable doll of claim 1, further comprising:

a controller, electrically connected with the air blower assembly;

a microphone, electrically connected with the controller and configured to collect a voice and transmit the voice signal to the controller;

a speaker, electrically connected with the controller;

a first speech recognizing server, electrically connected with the controller and configured to recognize a processed voice signal of controller and transmit a recognition result to the controller;

a chip, electrically connected with the controller and pre-storing vocabularies, the chip is configured to output a feedback to the controller according to the vocabularies and the recognition result; and a second speech recognizing server, electrically connected with the controller and configured to transmit the feedback to the speaker, so that the controller is capable of communicating with a user and sending an instruction to the air blower assembly or the speaker to control an operation of the air blower assembly or the speaker.

3. The inflatable doll of claim 2, wherein at least one of the controller, the microphone, the speaker, the first speech recognizing server, the chip and the second speech recognizing server is received in the body.

4. The inflatable doll of claim 2, further comprising:

at least one lamp, received in the body and electrically connected with the controller, the controller is configured to communicate with the user and send another instruction to the at least one lamp to control an operation of the at least one lamp.

5. The inflatable doll of claim 1, wherein each second air blower is at least partially received in the one corresponding second air inlet.

6. The inflatable doll of claim 5, wherein each second air blower comprises:

a housing;

an air inlet portion, connected with the housing and received in the expandable member by the second air inlet; and an air outlet portion, connected with the housing and arranged outside the expandable member.

7. The inflatable doll of claim 5, further comprises a connecting member, the connecting member is configured to connect the second air blower with an edge of the second air inlet.

8. The inflatable doll of claim 1, wherein;

each of the expandable members comprises a substantially triangular prism shape, a substantially hexahedral shape, or an irregular shape; or each of the expandable members comprises a top surface, a bottom surface and a side surface, the second air inlet is defined in the top surface, the bottom surface or the side surface; or at least one surface of each of the expandable members is arc-shaped, and the arc-shaped surface is connected with the body.

9. The inflatable doll of claim 1, wherein the body comprises a primary portion, the expandable members comprise at least two first expandable members, the at least two first expandable members are received in the primary portion and arranged adjacent to each other at a same height.

10. The inflatable doll of claim 9, wherein each of the second air blowers comprises an air outlet portion, the air outlet portions of the second air blowers corresponded to the at least two first expandable members faces towards a same direction or different directions.

11. The inflatable doll of claim 9, wherein the body comprises a secondary portion, the expandable members further comprise at least two second expandable members, the at least two second expandable members are received in the secondary portion and arranged adjacent to each other at a same height.

12. The inflatable doll of claim 11, wherein each of the second air blowers comprises an air outlet portion, the air outlet portions of the second air blowers corresponded to the at least two second expandable members faces towards a same direction or different directions.

13. The inflatable doll of claim 11, wherein the body comprises a plurality of secondary portions, each of the secondary portions comprises a first secondary portion and a second secondary portion adjacent to the first secondary portion, the expandable members further comprise at least two third expandable members, the at least two third expandable members are respectively received in the first secondary portion and the second secondary portion, and arranged at a same height.

14. The inflatable doll of claim 13, wherein each of the second air blowers comprises an air outlet portion, the air outlet portions of the second air blowers corresponded to the at least two third expandable members faces towards a same direction or different directions.

15. The inflatable doll of claim 13, wherein the expandable members further comprise at least one fourth expandable member, the at least one fourth expandable member comprises a first expandable portion, a second expandable portion and a connecting portion, the first expandable portion is communicated with the second expandable portion by the connecting portion.

16. The inflatable doll of claim 15, wherein:

the connecting portion is expandable or rigid; or a cross-sectional area of the first expandable portion is one to three times that of the connecting portion; or a cross-sectional area of the second expandable portion is one to three times that of the connecting portion.

17. The inflatable doll of claim 15, wherein the first expandable portion comprises a first surface opposite to the connecting portion, the second expandable comprises a second surface opposite to the connecting portion, the first surface and the second surface are inclined towards a same direction.

18. The inflatable doll of claim 17, wherein;

the first surface is parallel with the second surface; or the first surface comprises a first end and a second end, the second surface comprises a third end and a fourth end, a first inclining direction from the first end to the second end is parallel with a second inclining direction from the third end to the fourth end.

19. The inflatable doll of claim 15, wherein the first expandable portion comprises a first surface opposite to the connecting portion, the second expandable comprises a second surface opposite to the connecting portion, the first surface or the second surface is provided with one second air blower.

20. The inflatable doll of claim 15, wherein the first expandable portion comprises a third surface, the second expandable comprises a fourth surface, each of the third surface and the fourth surface defines a connecting hole, the connecting portion defines a through hole, the first expandable portion is communicated with the second expandable portion by the connecting holes and the through hole.

* * * * *